United States Patent [19]

Schütz

[11] Patent Number: 4,878,448

[45] Date of Patent: Nov. 7, 1989

[54] WISHBONE BOOM MOUNTING FOR SAILBOARDS

[76] Inventor: Udo Schütz, Rückersteg 4, D-5418 Selters, Fed. Rep. of Germany

[21] Appl. No.: 217,224

[22] Filed: Jul. 11, 1988

[30] Foreign Application Priority Data

Jul. 11, 1987 [DE] Fed. Rep. of Germany ... 8709564[U]

[51] Int. Cl.[4] ..... B63B 15/00

[52] U.S. Cl. ..... 114/98

[58] Field of Search ..... 114/39.2, 39.1, 98, 114/102; 248/74.3

[56] References Cited

FOREIGN PATENT DOCUMENTS

| | | |
|---|---|---|
| 8301796 | 8/1983 | Fed. Rep. of Germany . |
| 8418494 | 1/1985 | Fed. Rep. of Germany . |
| 8511887 | 7/1985 | Fed. Rep. of Germany . |
| 8628157 | 1/1987 | Fed. Rep. of Germany . |
| 3411042 | 5/1987 | Fed. Rep. of Germany . |
| 2558091 | 7/1985 | France . |

*Primary Examiner*—Joseph F. Peters, Jr.
*Assistant Examiner*—Jesûs Sotelo
*Attorney, Agent, or Firm*—Young & Thompson

[57] ABSTRACT

Wishbone boom mounting for sailboards with a wishbone head section of a synthetic resin, integrally molded onto a curved pipe section of aluminum or synthetic resin for attaching the two spars of a wishbone boom, and a jacket section accommodating the curved pipe section. A collar is connected to the jacket section by at least one web and is placeable on the mast. A locking element is articulated to this collar and receives the mast. A quick-action closure closes and opens the locking element in order to mount the head section to the mast or to detach the head section from the mast. A hinged cover (10) is molded onto the collar (6) of the wishbone head section (1) by a thin flexible hinge (11) and is curved to match the mast (5). A clamping lever (12) is articulated to the collar (6) for tightening and releasing a rope piece (13) forming a loop (14), one end of this rope piece being attached to the clamping lever (12) and the other end to the collar (6) in the region of the thin flexible hinge (11). The loop (14) of this rope piece is tensionable for attaching the wishbone head section (1) to the mast (5) by the clamping lever (12) by an extension (20) on the collar (6) opposite the closing rim (19) of the hinged cover (10) and by guides (22, 23) on the outside of the hinged cover (10).

7 Claims, 1 Drawing Sheet

WISHBONE BOOM MOUNTING FOR SAILBOARDS

Figure 1:
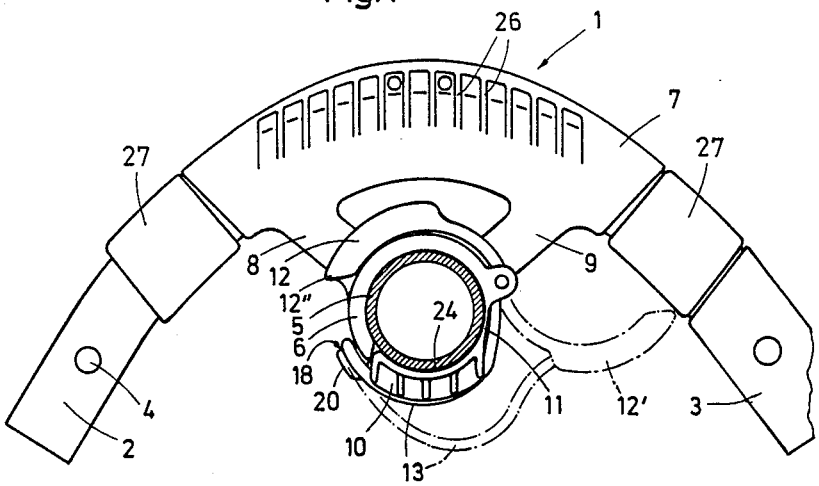

The invention relates to a wishbone boom mounting for sailboards with a wishbone head section of a synthetic resin, integrally molded onto a curved pipe section of aluminum or synthetic resin for attaching the two spars of a wishbone boom and comprising a jacket section accommodating the curved pipe section, a collar connected to the jacket section by at least one web and placeable onto the mast, a locking element adapted to the mast being articulated to the collar, and a quick-action closure for closing and opening the locking element in order to mount the head section to the mast and, respectively, for detaching this head section from the mast.

In such a wishbone boom mounting, known from German Utility Model G 84 18 494.9, the locking means for attaching the wishbone head section to the mast consists of a semicircular pressure plate movably connected to the wishbone boom on one side by means of a rope loop and exhibiting, on the other side, an extension for suspending therein a loop formed by a further rope piece, for attaching the wishbone head section onto the mast, one end of this last-mentioned loop being connected, after being rerouted by more than 90° through an eye threaded into the head section, to the clamping lever, articulated to the head section, of a quick-action clamping closure, and the other end thereof, after being rerouted by more than 90°, being attached, through a further eye threaded into the head section, in a curry-type clamp mounted to the wishbone boom. For connecting mast and wishbone boom, the rope loop is suspended in the pressure plate, and the clamping lever is turned over whereby the pressure plate of the wishbone head section is urged against the mast.

This conventional wishbone boom mounting is very expensive. Furthermore, there is the danger that, during the releasing and fastening of the wishbone boom from and, respectively, to the mast, the sail is caught in the closure of the wishbone head section and is damaged.

The invention is based on the object of simplifying the wishbone boom mounting of this type and to render same safe in its operation.

The novel wishbone boom mounting is distinguished by a simple structure and affords rapid and secure connection of wishbone boom and mast in the form of an initially provided equipment and also as an accessory part for the retrofitting of commercially available wishbone booms.

Figure 2:
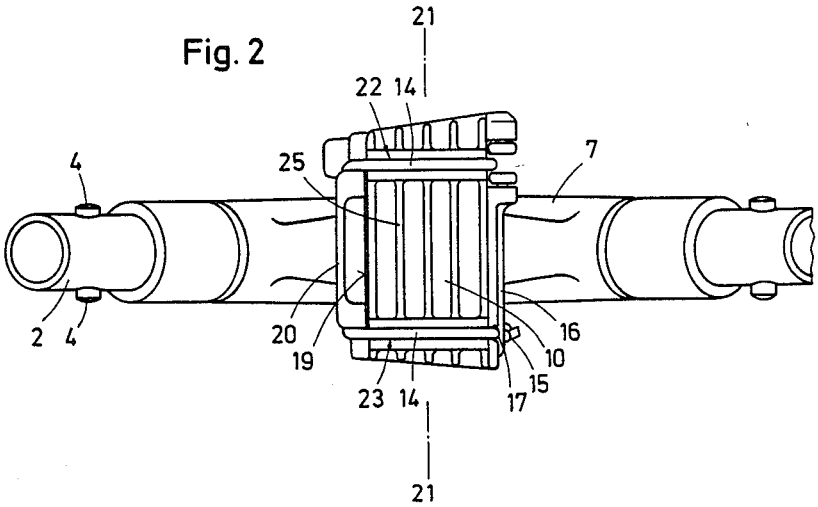

The invention will be described in detail below with reference to an embodiment illustrated in the drawing wherein:

FIG. 1 is a top view of the wishbone boom mounting according to this invention, and FIG. 2 is a front view of the wishbone boom mounting.

The wishbone boom head section (1) of the wishbone boom mounting for sailboards according to FIGS. 1 and 2 comprises a curved pipe section (2) of aluminum or a synthetic resin for placement of the two spars (3) of a wishbone boom, these spars being held on the curved pipe section (2) by means of snap closures (4). A one-piece connecting member of a synthetic resin material, e.g. polyurethane, is molded onto the curved pipe section (2). This connecting member consists of a sleeve-like collar (6) that can be placed onto the mast (5) of a sailboard and can be fixedly connected thereto, and of a jacket section (7) accommodating the curved pipe section (2), as well as of two short webs (8, 9) radially arranged with respect to the collar (6) and joining the collar (6) and the jacket section (7) with each other.

A hinged cover (10) curved in correspondence with the mast (5) is molded by way of a thin flexible hinge (11) to the collar (6) of the wishbone head section (1).

Furthermore, the clamping lever (12) of a quick-action closure for tightening and releasing a piece of rope (13) forming a loop (14) is articulated to the collar (6), one end of this rope piece being attached to the clamping lever (12), and the other end thereof being attached by means of a knot (15) in a bore (17) in a web (16) at the collar (6) in the zone of the thin flexible hinge (11) and below the clamping lever (12).

For attaching the wishbone head section (1) to the mast (5), the loop (14) of the rope piece (13) is first suspended, with the clamping lever (12') being opened, into a groove (18) of a strip-shaped extension (20) on the collar (6), this extension lying in opposition to the closing rim (19) of the hinged cover (10) and extending in parallel to the central longitudinal axis (21—21) of the collar (6), and subsequently the rope piece loop (14) is tightened by turning the clamping lever (12) into the closed position (12'') by way of guide grooves (22, 23) on the outside of the hinged cover (10), so that the latter is firmly urged against the mast (5), thereby ensuring a secure seating of the wishbone head section (1) on the mast (5).

The guide grooves (22, 23) for the loop (14) of the rope piece (13) are arranged on the outer periphery of the hinged cover (10), extending in parallel at the distance of the longitudinal dimension of the extension strip (20).

The inside of the hinged cover (10) is coated with a nonslip material (24), e.g. rubber, in order to ensure good adhesion to the mast (5) which latter is made of aluminum.

The outside of the hinged cover (10) exhibits profiling (25), reducing the weight.

For the same purpose, the jacket section (7) of the wishbone head section (1) is equipped with profiling (26) on the topside and underside, which also acts as a shock absorber.

In order to attain a transition identical in diameter between the jacket section (7) and the spars (3), beneficial for gripping, corresponding sleeves (27) are provided at that location.

What is claimed is:

1. In a wishbone boom mounting for sailboards with a wishbone head section of a synthetic resin, integrally molded onto a curved pipe section for attaching the two spars of a wishbone boom, and a jacket section accommodating the curved pipe section, a collar connected to the jacket section by at least one web and being placeable onto the mast, a locking element being articulated to this collar and having an inner contour that matches the outer contour of the mast, and a quick-action closure for closing and opening the locking element in order to mount the head section to the mast and, respectively, for detaching the head section from the mast; the improvement comprising a hinged cover (10) molded onto the collar (6) of the wishbone head section (1) by way of a thin flexible hinge (11) and having an inner contour that matches the outer contour of the mast (5), as well as a clamping lever (12) articulated to the collar (6) for tightening and releasing a rope piece (13) forming a loop (14), one end of this rope piece being attached to the clamping lever (12) and the other end thereof being attached to the collar (6) in the region of the thin flexible hinge (11), the loop (14) of said rope piece being tensionable for attaching the wishbone head section (1) to the mast (5) by means of the clamping lever (12) by an extension (20) on the collar (6) lying opposite the closing rim (19) of the hinged cover (10), as well as by guides (22, 23) on the outside of the hinged cover (10).

2. Wishbone boom mounting according to claim 1, wherein said extension (20) for attaching the tightening loop (14) of the closure rope piece (13) of the quick-action closure is fashioned as a strip extending in parallel to the central longitudinal axis (21—21) of the collar (6) and exhibiting a suspension groove (18).

3. Wishbone boom mounting according to claim 1, wherein said guides comprise two guide grooves (22, 23) extending on the outer periphery of the hinged cover (10) at the collar (6) at the distance of the longitudinal dimension of the extension strip (20) in parallel, for the tightening loop (14) of the closure rope piece (13).

4. Wishbone boom mounting according to claim 1, wherein the inside of the hinged cover (10) is coated with a nonslip material (24).

5. Wishbone boom mounting according to claim 4, wherein the outside of the hinged cover (10) exhibits profiling (25) reducing the weight.

6. Wishbone boom mounting according to claim 1, further comprising weight-reducing profiling (26) on the topside and underside of the jacket section (7) of the wishbone head section (1).

7. Wishbone boom mounting according to claim 1, further comprising sleeves (27) of the same diameter between the jacket section (7) and the spars (3).

* * * * *